US006419782B1

(12) United States Patent
Johnson et al.

(10) Patent No.: US 6,419,782 B1
(45) Date of Patent: Jul. 16, 2002

(54) BAR CODE OVERLABELING SYSTEM

(75) Inventors: David A. Johnson, Waukesha; Robert J. Chmielewski, Hales Corners; James V. Lysaught, Mequon, all of WI (US)

(73) Assignee: Dorner Mfg. Corp., Hartland, WI (US)

( * ) Notice: Subject to any disclaimer, the term of this patent is extended or adjusted under 35 U.S.C. 154(b) by 0 days.

(21) Appl. No.: 09/457,981

(22) Filed: Dec. 9, 1999

(51) Int. Cl.[7] ..... B65C 1/00; B65C 9/00; B65C 9/44; B65C 9/46

(52) U.S. Cl. ..... 156/277; 156/64; 156/249; 156/351; 156/363; 156/387; 156/542; 156/DIG. 1; 156/DIG. 24; 156/DIG. 46; 156/DIG. 47

(58) Field of Search ..... 156/64, 249, 277, 156/351, 362, 363, 387, 542, DIG. 1, DIG. 2, DIG. 24, DIG. 25, DIG. 44, DIG. 45, DIG. 46, DIG. 47

(56) References Cited

U.S. PATENT DOCUMENTS

| | | | | |
|---|---|---|---|---|
| 3,989,574 A | | 11/1976 | Evans | 156/351 |
| 3,989,577 A | | 11/1976 | Watson | 156/364 |
| 4,181,561 A | | 1/1980 | Seragnoli | 156/566 |
| 4,662,971 A | | 5/1987 | Adams | 156/270 |
| 5,342,461 A | * | 8/1994 | Murphy | |
| 5,427,029 A | * | 6/1995 | Dumke | |
| 5,586,685 A | | 12/1996 | Dorner et al. | 221/197 |
| 5,738,755 A | | 4/1998 | Hartman | 156/566 |
| 6,220,330 B1 | * | 4/2001 | O'Brien, Jr. | |

FOREIGN PATENT DOCUMENTS

EP 0 441 617 A1 8/1991

* cited by examiner

*Primary Examiner*—Curtis Mayes
(74) *Attorney, Agent, or Firm*—Andrus, Sceales, Starke & Sawall,

(57) ABSTRACT

An automatic label printing and application system applies a custom label at a dynamically determined location on articles being moved along a conveyer. The system includes a bar code scanning system, preferably a group of bar code scanners each arranged to read at an assigned elevation above the conveyer belt. This configuration allows the system controller to generally determine the vertical height of pre-printed bar code on the article. The system uses photoelectric sensors to detect articles being moved along the conveyer, as well as an encoder and bar code scanning data to determine the horizontal position of the pre-printed bar code on the surface of the article. In this manner, the system dynamically determines both the vertical and horizontal position of the pre-printed bar code on the surface of the article. The system further includes a series of label printing and application stations that are configured to print customized labels on the surface of the article in a horizontal and vertical position to cover the pre-printed bar code, at least partially. In general, the stations are adjusted to apply labels at different elevations above the conveyer belt. The application elevation of labels is selected by selecting the appropriate label printing and application stations. The horizontal position of the label on the article is determined by coordinating encoder pulses in response to signals from photoelectric sensor for the respective label printing and application unit. The system also preferably includes a verification bar scanner at the downstream end to verify that an accurate label has been properly positioned on the article.

13 Claims, 5 Drawing Sheets

FIG. 3
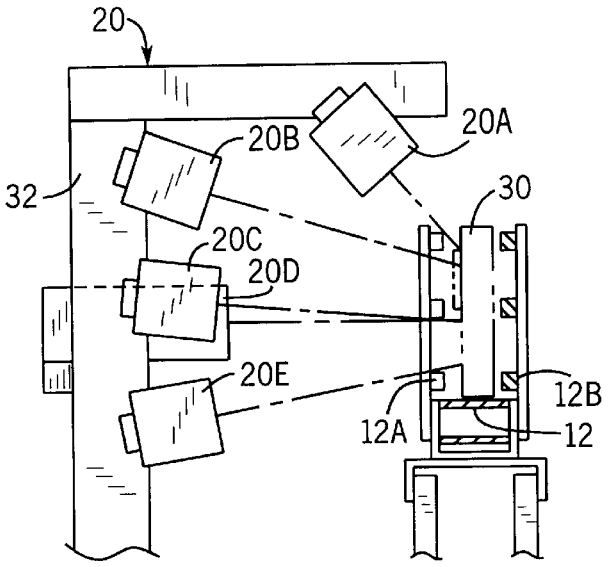
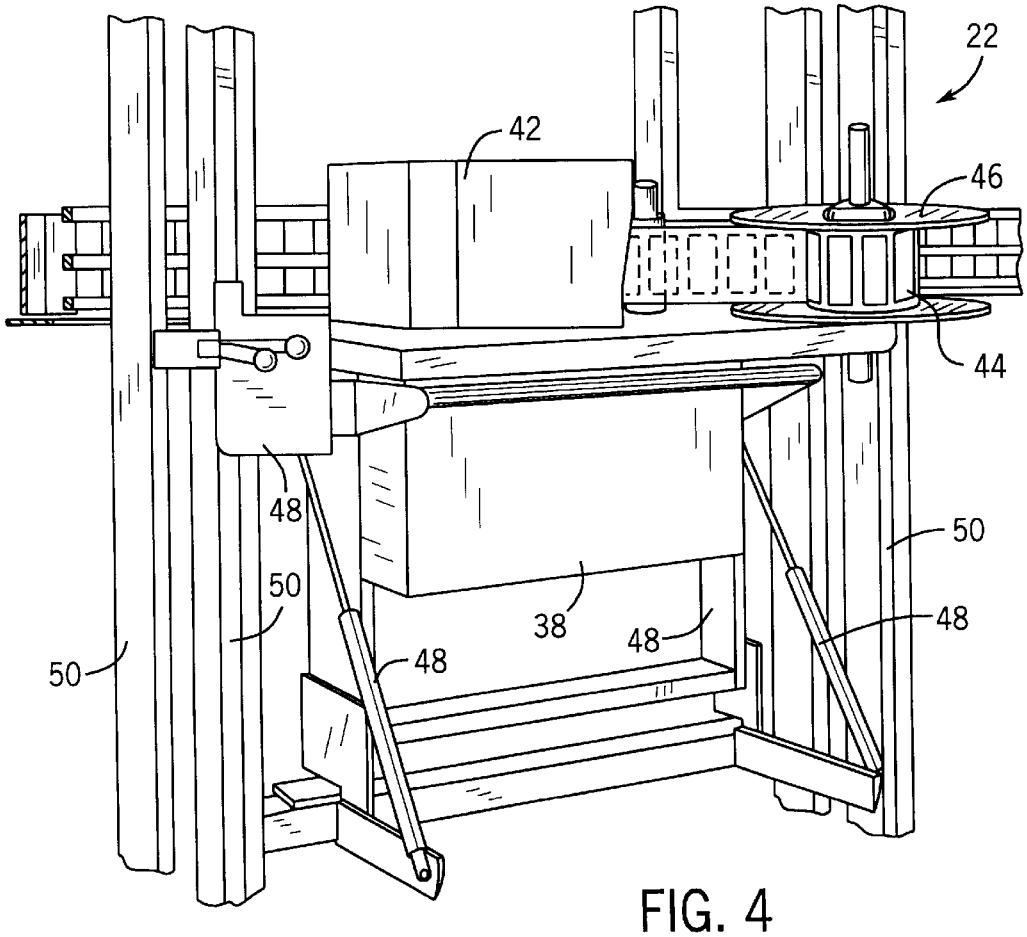
FIG. 4

BAR CODE OVERLABELING SYSTEM

FIELD OF THE INVENTION

This invention relates to bar code labeling systems, and in particular to a bar code labeling system that prints and applies a bar code label to articles being conveyed on a conveyer belt. More specifically, the invention detects the location of pre-printed bar code labels on an assortment of articles being transported on a conveyer belt in single file, and prints and applies another label to the article covering the pre-printed bar code label.

BACKGROUND OF THE INVENTION

In large distributions applications, sortation conveying systems are typically used to fulfill orders of intermingled articles such as assortments of books, video cassette containers, packaged software, compact disc containers, etc. Workers load items into the system and the articles are conveyed in single file within individual pockets on a core conveyer belt for the sortation conveying system. As the assorted articles begin to move through the system on the core conveyer belt, the system reads pre-printed bar code information on each respective article. This bar code information is transmitted to a system controller that instructs the system with respect to further downstream processing and sorting of the articles into the various outgoing orders.

It is typical for a conveyer sortation system to include label printing and application stations along the core conveyer belt upstream of the stacking stations for the outgoing orders. Typically, the post-applied label is custom generated for the specific article after the pre-printed bar code on the article is read. The post-applied label sometimes contains another bar code specific to the company operating the sortation conveying system for use at check out, and also often contains tracking or other information pertinent to the product. In many cases, the post-applied bar code label is affixed to the article in a location different from the location of the pre-printed bar code on the article. This presents a situation in which two bar codes are present on the article, one of which is pre-printed and the other of which is post-applied. The presence of two bar codes on an article can, however, lead to confusion for check-out workers, and can also lead to improper tracking and inventory data monitoring. In some circumstances, it is therefore desirable for the post-applied label to cover the pre-printed bar code on the article.

SUMMARY OF THE INVENTION

The invention is an automatic overlabeling system that dynamically senses the location of a pre-printed bar code on an article, and custom prints and applies another label on the article covering the pre-printed bar code. Normally, "bar code" will be printed on the applied label. In this manner, only a single bar code is present on the article, and thus confusion by retail check-out workers or other workers using bar code scanners is alleviated.

The system dynamically determines the location of the pre-printed bar code on each respective article being moved along the core conveyer for a sortation conveying system. This is accomplished at a rate of approximately 250 articles per minute. The system includes a bar code scanning system which normally consists of a plurality of bar code scanners, each assigned to read along an assigned orientation in an assigned region above the conveyer in search of pre-printed bar code information on articles being moved along the conveyer. A typical system would have five such bar code scanners. Two linear scanners are used to read ladder orientated bar code. Three raster scanners are used to read picket fence orientated bar code. The system also includes a series of label printing and application stations, preferably six. Each is adjusted to apply labels at a specific elevation on the surface of articles being moved along the conveyer. The label printing and application stations are located downstream from the bar code scanners. Each label printing and application station preferably includes a photoelectric sensor that senses the presence of article being conveyed into the station, as well as a microprocessor or station controller. The system also includes an overall system controller, preferably a PC, which controls the bar code scanners, creates a label format data for the label printing and application stations, and determines which station is to be used to print and apply the label on the respective article. The system also preferably includes a photoelectric sensor located at the input of the system to detect a presence of articles entering the system, as well as an encoder that monitors movement of the conveyer to provide article position tracking data. The system controller inputs a signal from the system photoelectric sensor as well as data signals from the bar code scanners and outputs control signals to the micro-controllers for the various label printing and application stations. Based on the information gathered by the system photoelectric sensor and the bar code scanners, the system controller calculates the vertical and horizontal position at which the label should be applied on the respective article. This information is transmitted to the label printing and application stations. In turn, the appropriate label printing and application station applies a label to the surface of the article at a location that covers at least a portion of the surface on which the pre-printed bar code is located.

The system preferably operates in the following manner. Articles are moved along the conveyer in single file. As an article enters the system, it is sensed by the photoelectric sensor and tracked by the system controller using data from the conveyer encoder. The data from the encoder is also transmitted to the controllers for the various label printing and application stations. The system controller tracks all the articles passing through the system individually. When the system photoelectric sensor senses that an article is entering the system, the system controller instructs the bar code scanners to read the moving article. The bar code scanners transmit the following information to the system controller: 1) any decoded bar code data that has been read, 2) data on the position of the bar code label on the article, and 3) data on the length of the article. The system controller is preprogrammed with the mounting location of each bar code scanner. Based on this information, the system controller is programmed to select the appropriate label printing and application station for printing and applying the label to the article. As mentioned, each label printing and application station is adjusted to apply labels at a specific height on the surface of articles being moved along the conveyor. The system controller then transmits control signals to the appropriate label printing and application station, regarding both the required label format data and position information. As mentioned, each label printing and application station has a dedicated station controller (e.g. microprocessor) which receives the control signals from the system controller. The station controller processes the data sent by the system controller and calculates the correct horizontal (i.e., machine direction) label position location on the article. If the dynamically determined new label location is such that part of the new label would over hang or otherwise not be fully attached to the article surface, the station controller automatically adjusts the new label location data to ensure that the label is placed entirely on the article. When an article is detected by a photoelectric sensor for the appropriate label printing and application station, the station controller determines whether it has been instructed to label the article. If the station was not instructed to label the article, the article passes without being labeled to subsequent label printing and application stations. If the station was instructed to label the article, the station controller instructs the station to apply the printed label when the article is in the correct horizontal position relative to the label printing and application unit.

In the preferred system, there are six label printing and application units. Three of the label application and printing units are adjusted to apply labels to the surface of article being moved along the conveyer at a first defined elevation above the conveyer, normally the lowermost region. Two of the label printing and application units are adjusted to apply labels at a second defined elevation above the conveyer, which is positioned higher than the first defined elevation. One of the label printing and application units is adjusted to apply labels on the surface of articles being moved along the conveyer at a third defined elevation. The third elevation is higher than the second and first defined elevations. This configuration is preferred because it is more likely that pre-printed bar code information appears on the surface of articles at the lower elevations, whereas less are located at the middle or higher elevations. In addition, some articles being conveyed through the system may not even have sufficient height to extend upward into the adjusted position for the highest label printing and application unit.

The above-described process is repeated for all articles entering into the system. The system is designed to be able to accommodate multiple articles each having assorted dimensions being conveyed through the system in single file. Preferably, a system in accordance with the invention can process information relating to multiple articles concurrently such that as one or more articles are being labeled, other articles may have entered the system and be in various stages of tracking and calculating information for the respective article.

BRIEF DESCRIPTION OF THE DRAWINGS

FIG. 3 is a detailed view taken along line 3—3 in FIG. 2 showing the preferred mounting location of bar code scanners used in the overlabeling system.

FIG. 4 is a perspective view of a label printing and application unit.

DETAILED DESCRIPTION OF THE INVENTION

Figure 1:
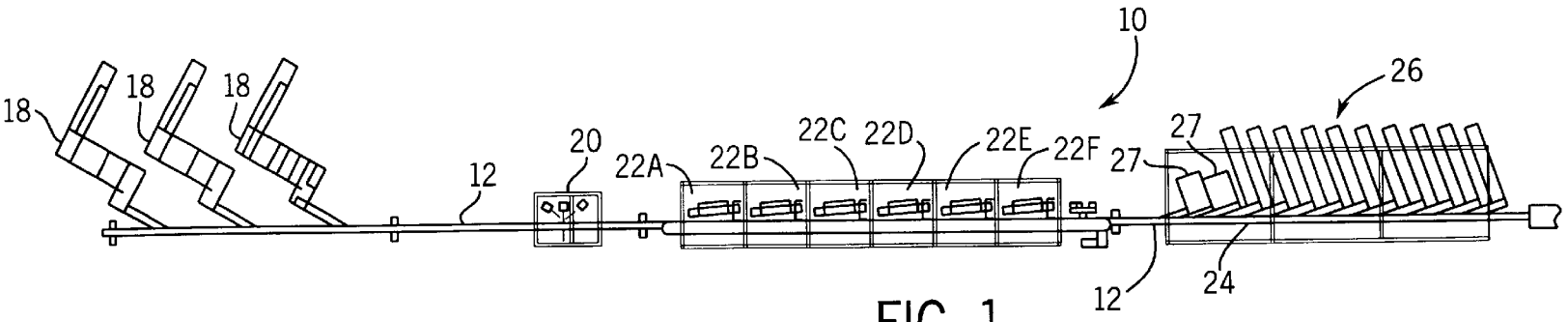
FIG. 1 is a schematic top view of a sortation conveying system that provides overlabeling in accordance with the invention.

FIG. 1 illustrates a sortation conveying system 10 that is capable of fulfilling orders of intermingled articles having assorted sizes, such as assorted books, intermingled with video cassette containers, compact disc containers, packaged software, or the like. The sortation conveying system 10 includes a core conveyer belt 12 that extends for essentially the entire length of the sortation conveying system 10, e.g. approximately 300 ft. The core conveyer belt 12 is divided into pockets of equal length (not shown). Each pocket is separated by a cleat on the conveyer belt 12. The core conveyer 12 operates at a relatively high rate of speed, for example, approximately 250 parts per minute can be processed and sorted by the system.

Referring still to FIG. 1, the sortation conveying system 10 includes a plurality of inductor stations 18 that load articles on to the core conveyer belt 12. Each of the articles is loaded onto the core conveyer belt 12 standing upright on edge and into an assigned pocket on the core conveyer belt 12. The core conveyer belt 12 then conveys articles in single file for downstream processing and sorting. The core conveyer 12 is preferably a continuous motion conveyer belt. The system 10 includes a bar code scanning station 20, and a series of label printing and application stations 22*a*–22*f*. At the downstream end of the system 10, the articles pass through a guide assembly 24 that includes a series of diverting gates and doors that are selectively operated to divert articles passing along on the core conveyer into one of several stacking stations 26. FIG. 1 shows ten stacking stations 26, each allocated to a specific outgoing order of assorted articles. A computer control system programs the guide assembly 24 to sort the articles traveling down the core conveyer 12 into the appropriate stacking station 26 to fulfill the assigned order. Orders typically contain up to or more than 100 assorted articles. If an article is not required to be diverted into one of the several stacking stations 26, the article is discharged to a leftover bin 27 from which it can be reprocessed at a later time.

Figure 2:
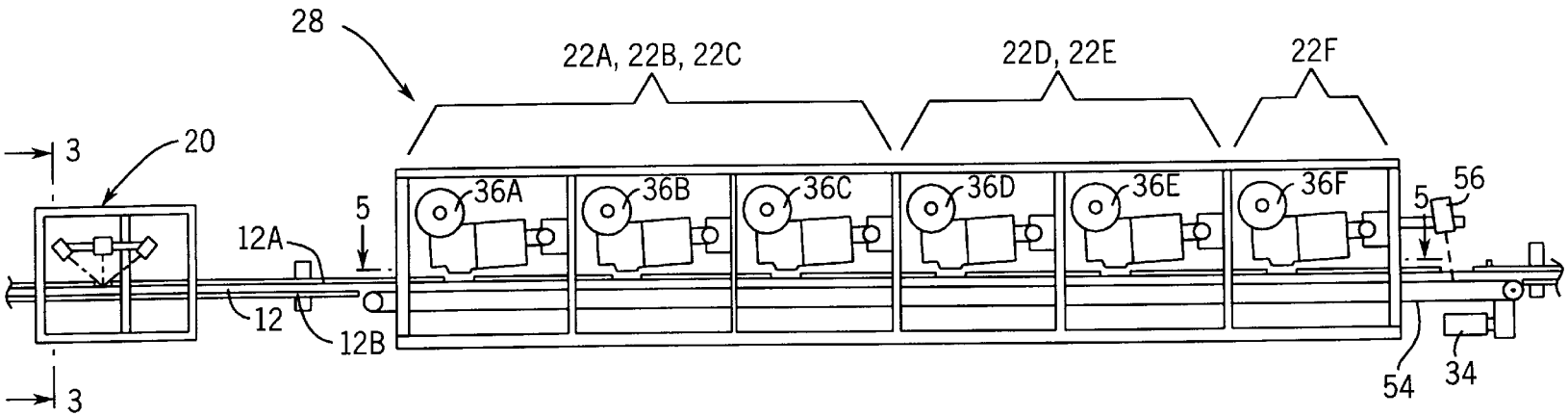
FIG. 2 is a top view of an overlabeling system in accordance with the invention.

Referring now to FIG. 2, the bar code scanners 20 and the series of label printing and application units 22*a*–22*f* are part of an automatic label application system that applies a printed label in a dynamically determined location on an article being moved along the core conveyer 12. As stated, the purpose of the automatic label printing and application system 28 is: 1) to determine the horizontal and vertical location of pre-printed bar code information on an article being moved along the conveyer 12; and 2) to print a customized label and apply the label to the surface to the article so that the post-applied label covers the pre-printed bar code, at least partially. In FIG. 2, assorted items are moved along the core conveyer belt 12 from left to right as the articles pass through the automatic label printing and application system 28. The core conveyer belt 12 has an attached encoder 34 to provide position tracking data for each article as it moves along on the conveyer 12. The encoder 34 monitors a belt 54 that is connected to the core conveyer 12 to facilitate tracking of articles 30 through the system 28. The belt 54 helps maintain the conveyed articles in a perpendicular position. In FIG. 2, the encoder 34 is shown to be located downstream of the label printing and application units 22*a–f*, but in many applications it may be convenient to locate the encoder 34 upstream. In addition, the system 28 includes a verification bar code scanner 56.

As the articles enter the system 28, guide rails 12*a*, 12*b* for the core conveyer 12 help maintain the article 30 in an upright, on edge orientation, see FIG. 3. Referring t o FIG. 3, the bar code scanner station 20 includes a plurality of bar code scanners 20*a*–20*e*, each capable of reading pre-printed bar code in formation on articles 30 that are passed through the bar code scanner station 20. Note that each of the each of the bar code scanners 20*a*–20*e* is mounted to a frame 32 and arranged to scan along an assigned viewing range defined a s a range. The conveyer belt guide rail 12*a* has an opening therein to accommodate the line of sight of the bar code scanners 20*a*–20*e*, see FIG. 2. In the preferred system, there are five bar code scanners 20*a*–20*e*, which are arranged to optimize the probability that at least one of the bar code scanners 20*a*–20*e* will read the pre-printed bar code data on conveyed articles whether the data is printed in picket fence orientation on the upper portion of the article 30 (scanner 20*b*), the middle portion of article 30 (scanner 20*c*), or the lower portion of the article 30 (scanner 20*e*), or in ladder orientation on the upper portion of the article 30 (scanner 20*a*) or the lower portion of the article 30 (scanner 20*d*). Scanners 20*a* and 20*b* are linear scanners which are mounted to the frame 32 preferably so that scanner 20*d* vertically scans the lower five inches above the conveyor belt, and scanner 20*a* vertically scans above the lower five inch area again preferably for five inches. The scanners 20*b*, 20*c*, 20*e* are mounted on the frame 32 to read the picket fence orientated bar code. These scanners 20*b*, 20*c*, 20*e* are raster scanners which sweep a designated horizontal on the conveyed articles. Suitable scanners 20*a*–20*e* can be purchased from Computer Identics, for example the Model CMAX 750. It should also be pointed out that the invention contemplates the replacement of the multiple scanners 20*a*–20*e* with an omniscanner (i.e., a single scanner which is capable of scanning in multiple directions). At the present time, it appears that the use of multiple scanners as described herein is more economical than the use of a single omniscanner. Also, in the future it may be possible to replace an omniscanner with a digital camera and computer which is programmed to determine the location of the bar code from a digital photograph. Thus, while the preferred bar code scanning system includes two linear scanners 20*a*, 20*d* and three raster scanners 20*b*, 20*c*, 20*e*, it should be apparent to those skilled in the art that other types of bar code scanning systems may be capable of dynamically determining the location of the pre-printed bar code on the surface of the conveyed article. It is contemplated that any such bar code scanning system is probably suitable for implementing the invention.

After the respective articles pass through the bar code scanning station 20, the articles enter a series of label printing and application stations 22*a*–22*f*. Each label printing and application unit 22*a*–22*f* in the series is able to print a customized label and apply the label at any position along the horizontal length of the moving article, depending on the timing at which the label is tamped or blown onto the article. Each label printing and application unit is mechanically adjusted to apply a label on the surface of the article at a specific elevation above the conveyer belt 12. FIG. 4 shows one of the label printing and applications units 22. The unit 22 includes an electronic control box 38 which houses an electronic controller for the station 22, preferably a microprocessor 40; and a label printing and tamping unit 42. A web 44 of blank labels or partially printed labels is loaded on roll support 46 and fed to the printing and tamping unit 42. The labels on the web 44 preferably have uniform dimensions, for example 1 inch wide by 3½ inches tall. The label printing and tamping unit 42, the roll support 46, and the control box 38 are all mounted to a frame structure 48 that is secured to support beams 50 installed adjacent the conveyer 12. An example of a suitable label printing and tamping unit 42 is the SATO print engine and the Labelaire print and apply labeler. These label printing and tamping units 42 are generally capable of applying 50–100 labels per minute.

Figure 5:
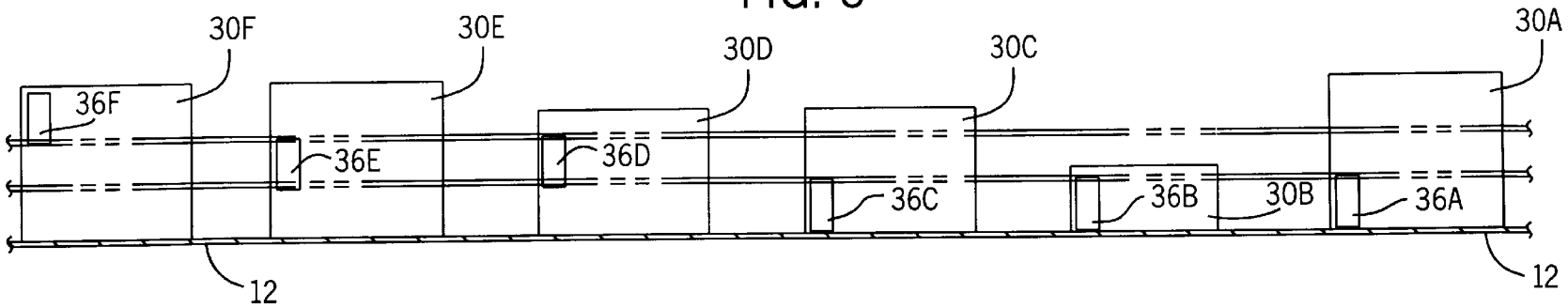
FIG. 5 is a schematic view taken along line 5—5 in FIG. 2 illustrating representative locations in which the various label printing and application units are set to apply labels to articles moving along the conveyer.
Figure 6:
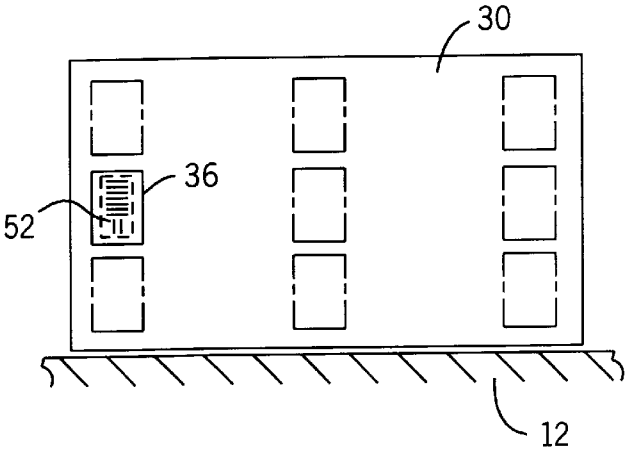
FIG. 6 is a schematic view showing a label applied to the surface of an article being moved by the conveyer so that the label covers a pre-printed label on the surface of the article.

Referring now to FIG. 2, 5, and 6, the use of multiple label printing and tamping units 22*a*–22*f* allows for faster system throughput, but more importantly allows application of labels at a variety of pre-selected elevations on the surface of articles above the conveyer belt. More specifically, each label printing and tamping unit is mechanically adjusted to apply a label at one of three elevations above the conveyer belt 12. FIG. 5 represents the height at which labels 36*a*–36*f* are applied onto the surface of articles 30*a*–30*f* by the respective label printing and tamping stations 22*a*–20*f* (see FIG. 2). In FIG. 5, there is an assortment of articles 30*a*–30*f* each generally rectangular but generally having various vertical and horizontal dimensions. The first three label printing and tamping units 22*a*–22*c* are adjusted to apply labels 36*a*, 36*b*, 36*c* on the surface of articles 30*a*, 30*b*, 30*c* being moved along the conveyer 12 at a first defined elevation above the conveyer 12, namely over the lowermost region of the surface of the articles 30*a*, 30*b*, 30*c*. The labels 36*a*, 36*b*, 36*c* do not hang over the lower edge of the articles 30*a*, 30*b*, 30*c*. The next two label printing and application stations 22*d*, 22*e* are adjusted to apply labels 36*d*, 36*e* on the surface of articles 30*d*, 30*e* being moved along the conveyer 12 at a second defined elevation above the conveyer 12. The second defined elevation (i.e. units 22*d*, 22*e*) is higher than the first defined elevation at (i.e. initial units 22*a*, 22*b*, 22*c*). The last label printing and application unit 22*f* in the series applies labels 36*f* on the surface of articles 30*f* being moved along the conveyer 12 at a third defined elevation above conveyer 12. The third defined elevation (i.e. unit 22*f*) is higher than the second defined elevation (i.e. units 22*d* and 22*e*). As shown on FIG. 5, the series of label printing and application units 22*a*–22*f* is collectively able to apply a label 36*a*–36*f* to cover any vertical portion of the articles 30*a*, 30*f* being conveyed through the system 28. The location of label 36*f* at the third defined elevation above the conveyer 12 is selected preferably so that the label 36*f* spans from near the top edge of the article 30*f* downward.

While the sortation system 10, in general, and the automatic label application system 28, in particular, are able to handle assorted article having varying dimensions, it is important to know the dimensions of the product mix when selecting both label size, and the various defined elevations for setting the label printing and tamping units 22*a*–22*f*. In some circumstances, especially when it is necessary to accommodate severely oversized or undersized articles, it may be necessary to adjust label size and the number of label printing and tamping units set at each particular defined elevation. In addition, it may be desirable in some circumstances to apply labels to more or less than three defined elevations above the conveyer 12. The particular arrangement shown in FIG. 2 and 5 has been found to be particularly effective when applying labels 36 having a 1 inch width and a 3½ inch height. Preferably, the labels 36*a*–36*c* are applied to articles 30*a*–30*c* such that the top of the label 36*a*, 36*b*,

36*c* is located about 3.75 inches above the conveyer 12. Also preferably, the labels 36*d*, 36*e* are preferably applied to articles 30*d*, 30*e* such that the top of the labels 36*d*, 36*e* are 6.75 inches above the conveyer belt 12. The top of label 36*f* on article 30*f* is preferably located 9.75 inches from the conveyer belt 12. If the labels have a 3½ inch vertical length, there will therefore be narrow (0.5 inches) horizontal zones on the respective articles 30 which can be covered by either the labels 36*a*–36*c* at the first elevation or labels 36*d*, 36*e* at the second elevation, or either labels 36*e*, 36*d* at the second elevation the label 36*f* at the top elevation.

FIG. 6 shows a label 36 applied to an article 30 such that it covers a pre-printed bar code 52 on the surface of the article 30 as in accordance with the invention. Note that the vertical placement of the label 36 depends on which label printing and tamping unit 22*a*–22*f* applies the label 36 to the article 30, whereas the horizontal placement of the label 36 on the surface of the article 30 depends on the timing of the label application as the article 30 is moved along the conveyer 12 through the respective label printing and tamping machines 22*a*–22*f*.

Figure 8:
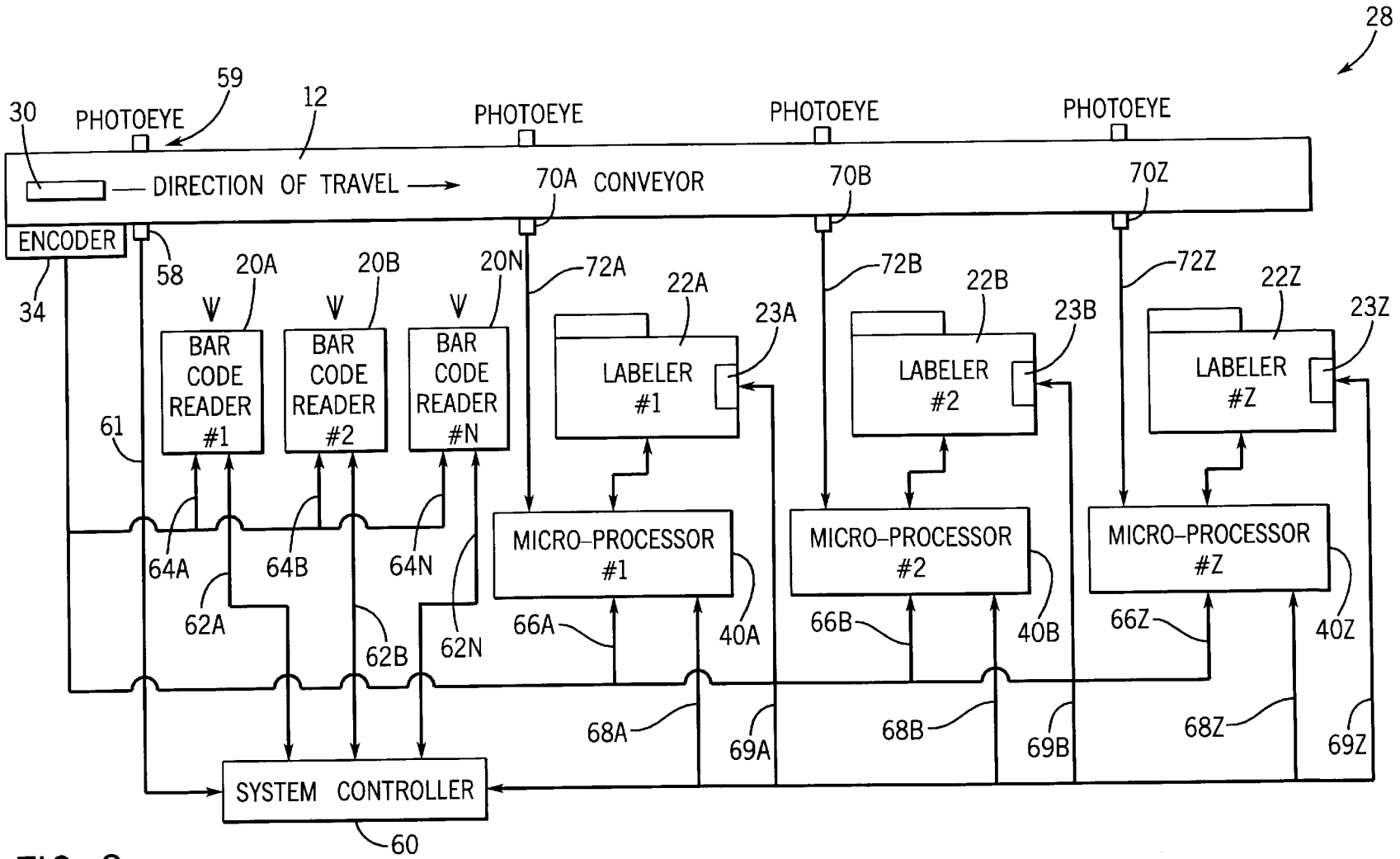
FIG. 8 is a diagram illustrating the flow of fundamental information in a preferred embodiment of the invention.

The operation of the automatic labeling application system 28 will now be explained in detail in connection with FIG. 8. In FIG. 8, the drawing is generalized in that it shows a plurality of bar code scanners 20*a*, 20*b* . . . 20*n* where reference numeral 20*n* refers to the $n^{th}$ bar code scanner. Likewise FIG. 8 shows label printing and application units 22*a*, 22*b* . . . 22*z* where reference numeral 22*z* refers to the $z^{th}$ label printing and application unit. The total number of bar code scanners (i.e. n) and the total number of label print and application units (i.e. z) can be varied in accordance with the invention depending on the particular application.

When an article enters the system 28 as it is being moved along the conveyer 12, a photoelectric sensor 58 senses the presence of the article 30 at an input location 59 for the system. The photoelectric sensor 58 transmits a system input signal through line 61 to a system controller 60. The system controller 60 is preferably a programmed personal computer that is responsible for overall surveillance and control of the automatic label printing and application system 28. The system controller 60 contains product specific data as well as control software and the like. Upon receiving a system input signal 61 from the photoelectric sensor 58 indicating that a new article 30 is present in the system 28, the system controller 60 instructs the bar code scanners 20*a*, 20*b* . . . 20*n* (via lines 62*a*, 62*b*, 62*n*) that an article is present and requests that the bar code scanners 20*a*, 20*b* . . . 20*n* scan the moving article 30 on the conveyer 12. As mentioned, each bar code scanner 20*a*, 20*b* . . . 20*n* is set to scan in a specific orientation on a specific region on the moving article 30.

The conveyer encoder 34 generates pulses to facilitate tracking and timing in the system. The encoder transmits pulses to the bar code scanners 20*a*, 20*b* . . . 20*n* via lines 64*a*, 64*b* . . . 64*n*. It also transmits pulses to the microprocessors 40*a*, 40*b* . . . 40*z* for the respective label printing and application units 22*a*, 22*b* . . . 22*z* via lines 66*a*, 66*b* . . . 66*z*.

The bar code scanners 20*a*, 20*b* . . . 20*n* begin counting encoder pulses as soon as the scanners 20*a*, 20*b* . . . 20*n* have received instructions from the system controller 60 that the article 30 is present at the system input location 59. Contemporaneously, the bar code scanners 20*a*, 20*b* . . . 20*n* begin scanning for bar code in the respective region. When the pre-printed bar code on the article 30 is read by one or more of the bar code scanners 20*a*, 20*b* . . . 20*n*, the respective scanners 20*a*, 20*b* . . . 20*n* transmit data to the system controller via lines 62, 62*b* . . . 62*n*. The scanners 20*a*, 20*b* . . . 20*n* transmit the following data to the system controller 60: 1) bar code data read on the respective article that has been decoded by the scanner, 2) positional data regarding the location of the pre-printed bar code on the surface of the article 30, and 3) data on the horizontal length of the article.

In response to this data from the bar code scanners 20*a*, 20*b* . . . 20*n*, the system controller 60 outputs control signals in lines 68*a*, 68*b*, 68 to the respective controllers or microprocessors 40*a*, 40*b*, 40 for the label printing and tamping units 22*a*, 22*b* . . . 22*z*. More specifically, the system controller 60 determines which label printing and application unit 22*a*, 22*b* . . . 22*z* should apply a label onto the surface of the article 30 in order that the label will be applied at an appropriate elevation on the surface of the article 30 above the conveyer 12 to cover the scanned pre-printed bar code on the article 30. In order to make this determination, the system controller 60 is pre-programmed with the scanning location for each bar code scanner 20*a*, 20*b* . . . 20*n*, and depending on which bar code scanner 20*a*, 20*b* . . . 20*n* reported data for the moving article 30, the system controller 60 selects an appropriate label printing and application unit 22*a*, 22*b* . . . 22*z*. The system controller 60 then transmits control signals via lines 68*a*, 68*b*, 68*z* which contain the required custom label data and positional information. Custom label data is transmitted directly to the respective print engine 23*a*, 23*b*. . . 23*a* via lines 69*a*, 69*b*. . . 69*z*.

The station controller or microprocessor 40*a*, 40*b*. . . 40*z* that receives the control signal from the system controller 60 processes the positional data. Each of the label printing and application stations has a photoelectric sensor 70*a*, 70*b* . . . 70*z* that detects the presence an article 30 inputting the station 22*a*, 22*b* . . . 22*z* at an input location for the station. The photoelectric sensors 70*a*, 70*b* . . . 70*z* each transmit a signal to the respective station controller 40*a*, 40*b* . . . 40*z* via lines 72*a*, 72*b*, 72*z* respectively. When an article is detected by one of the photoelectric sensors 70*a*, 70*b*, 70*z*, the respective station controller 40*a*, 40*b* . . . 40*z* determines whether the system controller 60 has instructed that this label printing and application unit apply a label to this article 30. If the article is to be labeled, the station controller 40*a*, 40*b* . . . 40*z* instructs the label printing and application unit 22*a*, 22*b* . . . 22*z* to apply a custom printed label when the article is in the correct horizontal location relative to the label printing and application unit. If the article is not to be labeled by the particular label printing and application unit, the article passes on the conveyer through the unit without being labeled but ready to have a label applied by a subsequent label printing and application unit. As the article 30 passes beyond the respective label printing and application unit 22*a*, 22*b* . . . 22*z*, the unit reports status to the respective station controller or microprocessor 40*a*, 40*b* . . . 40*z* which in turn passes the information to the system controller 60. The above process is repeated for all articles entering the system 28. Notably, the system in its preferred design is able to handle multiple articles within the system concurrently (i.e. subsequent articles may enter the system when other article are being labeled or in various other stages of being tracked through the system).

While the vertical elevation of the labels being applied to each respective articles is determined by the respective height of the individual label printing and application unit 22*a*, 22*b* . . . 22*z* in the series, the position of the label along the horizontal length of the article 30 is determined by the timing of the application of the label to the article. The station controller or microprocessor 40*a*, 40*b* . . . 40*z* coordinates this timing using positional information transmitted from the bar code scanners 20*a*, 20*b*. . . 20*n* via system controller 60 and pulses from encoder 34 via lines 66*a*, 66*b*. . . 66*z*. In this regard, the station controllers 40*a*, 40*b*. . . 40*z* preferably implement the control algorithms shown in FIG. 9 and FIG. 10. The control algorithm in FIG. 9 determines the number of encoder pulses that the microprocessor 40*a*, 40*b*. . . 40*z* should count between the time that the unit's photoelectric sensor 70*a*, 70*b*. . . 70*z* and the time that the unit should tamp or blow the label onto the article. Block 74 indicates that the station controller 40*a*, 40*b*, 40*z* waits for positional data from the bar code scanners 20*a*, 20*b*. . . 20*n* (which it receives via the system controller 60). Upon receiving the data, the microprocessor 40*a*, 40*b*. . . 40*z* parses the data string as illustrated by block 76. The microprocessor 40*a*, 40*b*. . . 40*z* continues to parse and reparse the data string until it obtains a good read, block 78. After obtaining the horizontal positional information, the station controller 40*a*, 40*b*. . . 40*z* converts the horizontal positional data into encoder counts, block 80. Then, the station controller 40*a*, 40*b* . . . 40*z* executes an adaptive product length compensation algorithm to ensure that the label will not hang off either the leading or trailing edge of the article, block 82. If necessary, the number of counts is adjusted, block 84. The station controller 40*a*, 40*b*. . . 40*z* then saves the count and the process begins again for the next data packet, block 86.

Figure 9:
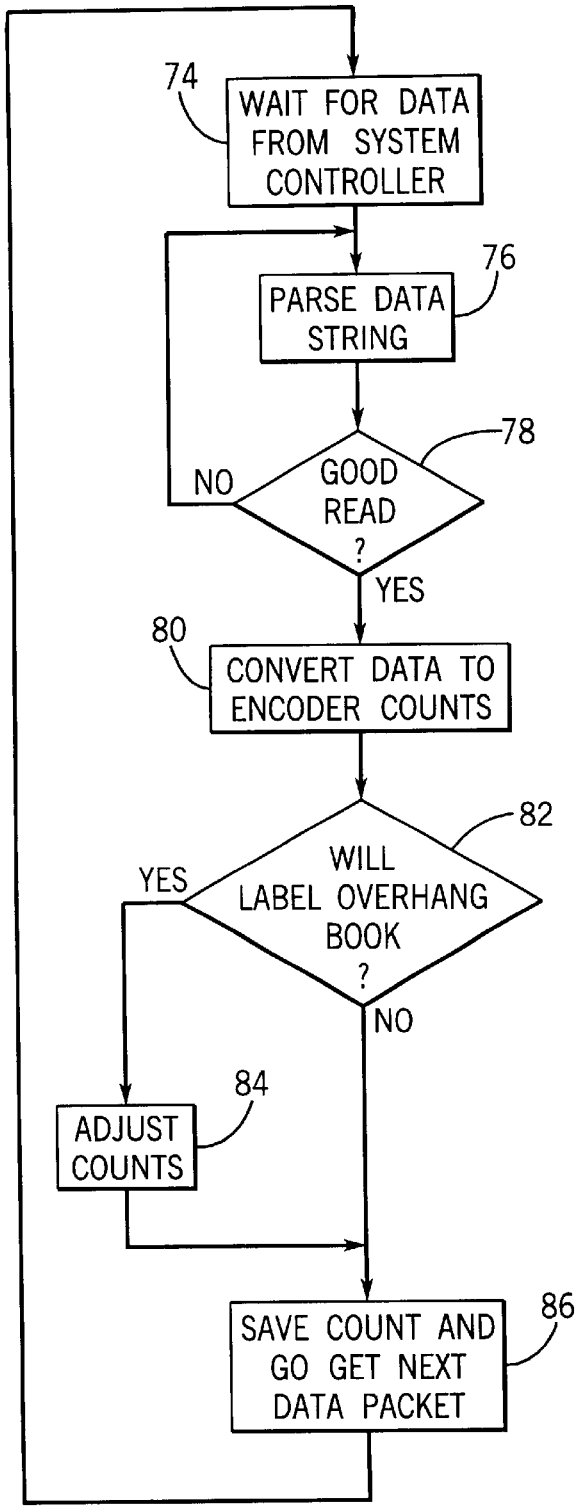
FIG. 9 is a flow chart illustrating bar code data analysis prior to applying the label to the surface of an article being moved by the conveyer.
Figure 10:
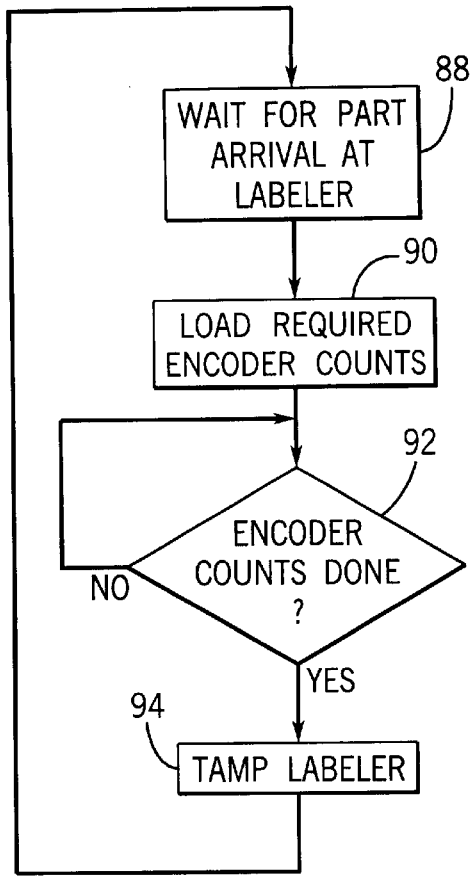
FIG. 10 is a flow chart illustrating the preferred analysis that the appropriate label printing and application station implements to track and label articles being conveyed.

Referring now to FIG. 10, the station controller 40*a*, 40*b*. . . 40*z* waits for the arrival of the article 30 to the respective station 22*a*, 22*b* . . . 22*z*, as illustrated by block 88. When the respective station controller 40*a*, 40*b*. . .40*z* receives a station input signal from the respective photoelectric sensor 70*a*, 70*b*. . . 70*z*, the number of encoder counts calculated by the algorithm in FIG. 9 is loaded, see block 90. The station controller 40*a*, 40*b* . . . 40*z* then counts the encoder pulses it receives via lines 66*a*, 66*b* . . . 66*z*, block 92. When the appropriate number of encoder pulses have been counted, the station controller 40*a*, 40*b* . . . 40*z* instructs the label printing and tamping unit 22*a*, 22*b*, 22*z* to tamp the label to the article 30, block 94. This process repeats for subsequent articles.

Figure 7:
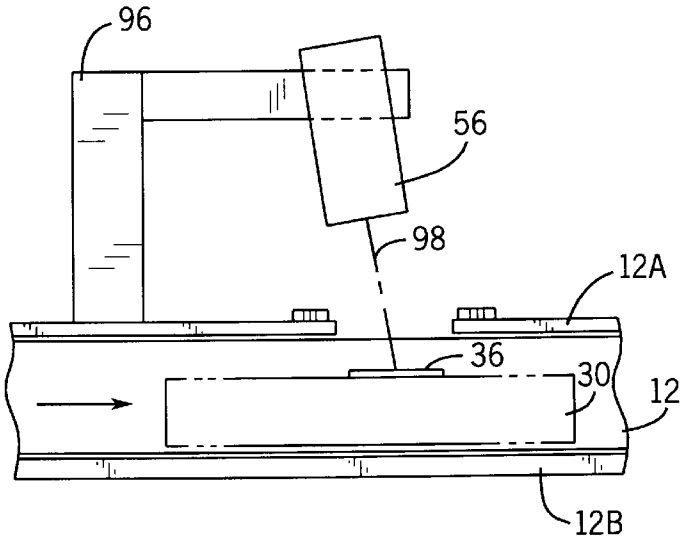
FIG. 7 is a view illustrating a verification bar code scanner located downstream of the series of label printing and application stations.

Referring again to FIG. 7, a verification bar code scanner 56 is located downstream of the series of label printing and application units 22*a*–22*f*. The verification bar code scanner 56 is mounted to a frame 96 attached to the core conveyer 12. An opening is provided in guide wall 12*a* for the core conveyer 12 to provide an opening for the line of sight 98 of the verification bar code scanner 56. The scanner 56 has a relatively large vertical viewing range. The purpose of the verification scanner is to read bar code information on the newly applied labels 36, thus verifying that the process has been completed accurately. In addition, this information is used by the system controller 60 to sort the articles downstream into the appropriate stacker stations 26. If verification does not occur for some reason, the article 30 will typically be discharged into a leftover bin 27.

The above description relates to a preferred embodiment of the invention. Various alternatives and other embodiments are contemplated as being within the scope of the invention and therefore reference should be made to following claims which particularly point out and distinctly claim the subject matter regarded as the invention.

We claim:

1. A method of automatically applying a label in a dynamically determined location on an article being moved along a conveyer, the method comprising the steps of:

a) moving articles upright on edge in single file along a conveyer;

b) sensing the presence of articles being moved along the conveyer as the respective article passes a system input location;

c) providing a bar code scanning system at a location along the conveyer downstream of the system input location;

d) providing a plurality of label printing and application stations in series at a location along the conveyer downstream of the bar code scanning system, the series including at least the first label printing and application station adjusted to apply labels on the surface of articles being moved along the conveyer at a first defined elevation above the conveyer, and a second label printing and application station adjusted to apply labels on the surface of articles being moved along the conveyer at a second defined elevation above the conveyer, the second defined elevation being higher then the first defined elevation;

e) instructing the bar code scanning system to read pre-printed bar code data on an article moving on a conveyer and sensed to be present at the system input location;

f) transmitting bar code data and positional data regarding the pre-printed bar code on a surface of the article from at least one of the bar code scanning system;

g) in response to the transmitted bar code data and positional data regarding the pre-printed bar code on the surface of the article, determining which label printing and application station should apply a label in order that the label will be applied at an appropriate elevation on the surface of the article above the conveyer to at least partially cover the pre-printed bar code on the surface of the article;

h) transmitting control signals to instruct appropriate label printing and application station to a apply a label to the surface of the article being conveyed; and i) using the appropriate label printing and application station to apply a label to the surface of the article so that the applied label cover at least a portion of a pre-printed bar code on the article.

2. A method as recited in claim 1 further comprising the steps of:

providing an encoder that tracks movement of the conveyer and outputs encoder pulses;

counting the number of encoder pulses between the time that the respective article is sensed to be present at the system input location and the time that the pre-printed bar code on the surface of the article is read by the bar code scanning system;

sensing the presence of the article being moved along the conveyer at an input location for the appropriate label printing and application station;

counting the number encoder pulses after the time that the article is sensed to be present at the station input location; and tamping said label printing and application station when an appropriate number of encoder pulses have been counted after sensing the presence of the article at the station input location.

3. A method as recited in claim 2 further comprising the step of adjusting the number of encoder pulse counts before tamping said label printing and application station so that the applied label does not hang over an edge of the surface of the article.

4. A method as recited in claim 1 wherein encoder pulse signals are transmitted to the bar code scanning system and also to the label printing and application stations.

5. A method as recited in claim 1 wherein the conveyer is a continuous motion conveyer having assigned pockets for individual articles being conveyed.

6. A method as recited in claim 1 wherein the series of label printing and application stations includes:

at least three label printing and application stations which are adjusted to apply labels on the surface of articles being moved along the conveyer at a first defined elevation;

at least two label printing and application stations which are adjusted to apply to labels on the surface of articles being moved along the conveyer at second defined elevation, the second defined being higher than the first defined elevation; and at least one label printing and application station which is adjusted to apply labels on the surface of articles being moved along the conveyer at a third defined elevation above the conveyer, the third defined elevation being higher then the second defined elevation.

7. A method as recited in claim 1 wherein:

the bar code scanning system transmits the bar code data and positional data regarding the pre-printed bar code on the surface of the article as well as data regarding the length of the article to an electronic controller;

selecting the appropriate label printing and application station to print and apply the label to the surface of the article; and transmitting control signals to instruct the selected label printing and application station to print and apply a label to the surface of the article being conveyed.

8. A method as recited in claim 1 wherein steps e)-i) are repeated for each article being moved by the conveyer.

9. A method as recited in claim 8 wherein all of the labels applied to articles being moved by the conveyer have uniform dimensions.

10. A method as recited in claim 1 wherein the bar code scanning system includes a plurality of bar code scanners.

11. A method as recited in claim 10 wherein the bar code scanning system includes two linear bar code scanners mounted to scan for bar code in the ladder orientation on the surface of articles being moved along the conveyor, and three raster scanners mounted to scan for bar code in a picket fence orientation on the surface of articles being moved along the conveyor.

12. A method as recited in claim 11 wherein the bar code scanning system comprises an omniscanner.

13. A method as recited in claim 11 wherein the bar code scanning system comprises a digital camera and a computer containing means for decoding bar code from digital photographs.

* * * * *